United States Patent [19]

Emmenthal et al.

[11] Patent Number: 4,712,581

[45] Date of Patent: Dec. 15, 1987

[54] DISTRIBUTION DEVICE FOR A TWO-PHASE FLOW

[75] Inventors: Klaus-Dieter Emmenthal, Wolfsburg; Joachim Neumann, Braunschweig, both of Fed. Rep. of Germany

[73] Assignee: Volkswagen Aktiengesellschaft, Wolfsburg, Fed. Rep. of Germany

[21] Appl. No.: 849,573

[22] Filed: Apr. 8, 1986

[30] Foreign Application Priority Data

Apr. 17, 1985 [DE] Fed. Rep. of Germany ..... 3513777

[51] Int. Cl.[4] ..... F02M 35/10; F02D 9/02

[52] U.S. Cl. ..... 137/561 A

[58] Field of Search ..... 137/561 A, 561 R

[56] References Cited

U.S. PATENT DOCUMENTS

| | | | |
|---|---|---|---|
| 2,373,099 | 4/1945 | Burk | 137/561 A |
| 3,848,633 | 11/1974 | Hurtig et al. | 137/561 A |
| 4,256,140 | 3/1981 | Swaroop et al. | 137/561 A |
| 4,494,568 | 1/1985 | Young | 137/561 A |

FOREIGN PATENT DOCUMENTS

DE 3304095 8/1984 Fed. Rep. of Germany .

*Primary Examiner*—Alan Cohan

*Assistant Examiner*—John Rivell

*Attorney, Agent, or Firm*—Brumbaugh, Graves, Donohue & Raymond

[57] ABSTRACT

A device for uniform distribution of a two-phase flow containing a liquid and a gaseous component, in particular a fuel-air mixture in a mixture delivery arrangement of an automobile, the device being provided with a flow-in line bore arranged centrally in a housing as well as with a plurality of flow-out line bores extending essentially in a plane perpendicular to the flow-in line and communicating with the flow-in line bore. The flow-in line bore is bounded by the end face of an obturating body which is pressed into a retaining bore arranged coaxially with the flow-in line bore but beyond the plane of the flow-out line bores. In order to create an optimal, uniform distribution effect coupled with a favorable possibility to check the formation of burrs or ridges in the zone of the intersecting edges of the bores, the diameter of the retaining bore is to be rendered substantially larger than the diameter of the flow-in line bore, and between the end face of the obturating body and the bottom of the retaining bore is formed a distribution space in the form of a narrow gap into which the flow-out line bores open.

14 Claims, 4 Drawing Figures

Fig.1
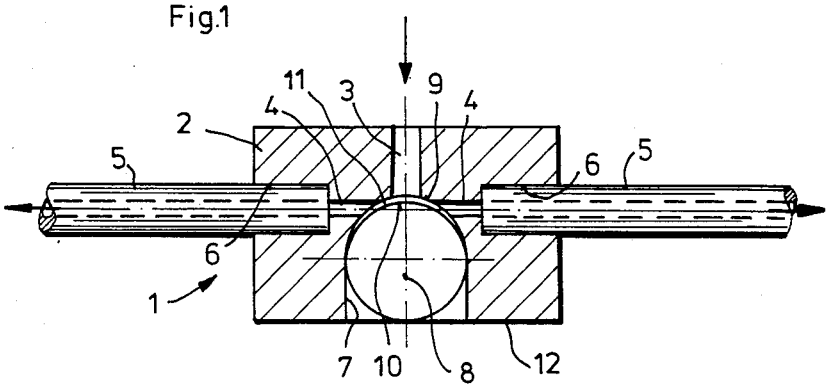
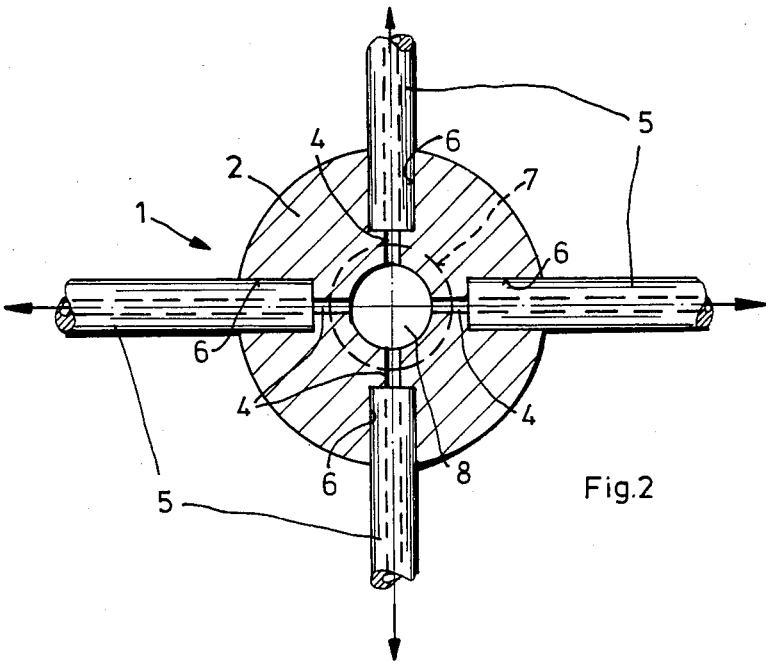
Fig.2

DISTRIBUTION DEVICE FOR A TWO-PHASE FLOW

BACKGROUND OF THE INVENTION

The invention concerns a device for the uniform distribution of a two-phase flow containing a liquid and a gaseous phase, in particular a fuel-air mixture in a mixture delivery arrangement of an automobile.

In mixture delivery arrangements of automobiles in which the liquid fuel is not directly admixed to the combustion air but rather a mixture of fuel and carrier air branched off the combustion air, a distribution device is required for distribution of the fuel air mixture allotted to the individual cylinders as a function of the operating state. However, this distribution device must comply with special requirements in order to ensure a uniform distribution of the fuel-air mixture present in the form of a two-phase flow. With such two-phase flows, which contain a liquid and a gaseous component, the occurrence of demixing processes must be avoided during distribution under all circumstances inasmuch as otherwise the two phases would be distributed non-uniformly to the individual outlets.

For example, from DE-OS No. 33 04 095 a distribution device is known whereby flow-out line bores are arranged essentially perpendicular to a flow-in line bore arranged centrally in a housing. In this case, it is provided that the flow-in line bore axially passes through the entire housing and is closed off merely on the side which, in the direction of flow, is behind the flow-out line bores by means of an obturating body or stopper which on the end facing the flow-in line bore is rendered as plane as possible and is pressed into a retaining bore to such depth that it partly covers the mouths of the distribution channels.

In case of such an arrangement in which the retaining bore is to have the same diameter as the flow-in line bore, there is a danger that burrs or ridges produced during manufacture in the zone of the intersecting edges between the flow-in line bore and the flow-out line bores cannot be removed with sufficient care. Yet, such burrs can impair the distribution of the two phase-flow delivered by way of the flow-in line bore and discharged by way of the flow-out line bores.

SUMMARY OF THE INVENTION

Therefore, it is an object of the invention to create a distribution device for a two-phase flow in a mixture delivery arrangement of an automobile which ensures the most favorable, i.e., the most uniform distribution of a two-phase flow, composed of a liquid and a gaseous component, to several outlets formed by the flow-out line bores. The device having a flow-in line bore arranged centrally in a housing, and a plurality of flow-out line bores arranged within a plane extending essentially perpendicularly to the flow-in line and connected with the flow-in line bore. The flow-in line bore being bounded by the end face of an obturating body which is pressed into a retaining bore which is arranged coaxially with the flow-in line bore beyond the plane of the flow-out bores.

Thus, according to the invention, the retaining bore must have a substantially larger diameter than the flow-in line bore, and between the end face of the obturating body andthe bottom of the retaining bore is to be created a distribution space in the form of a narrow gap into which the flow-out line bores open. In this manner it is possible to control and remove the burrs or ridges appearing in the intersecting-edge region of the bores through the large-diameter retaining bore. Moreover, a distribution space whose height can be specifically adjusted is formed whereby, through said space, the flow-in line bore is communicating with the flow-out line bores, such space taking care of a favorable and uniform distribution of the two-phase flow.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 shows a longitudinal section through a first embodiment of a distribution device pursuant to the present invention for an fuel-air mixture of a mixture delivery arrangement of an automobile;

FIG. 2 is a cross section of the distribution device shown in FIG. 1 passing through the plane of the flow-out line bores;

DETAILED DESCRIPTION OF THE PREFERRED EMBODIMENTS

Figure 3:
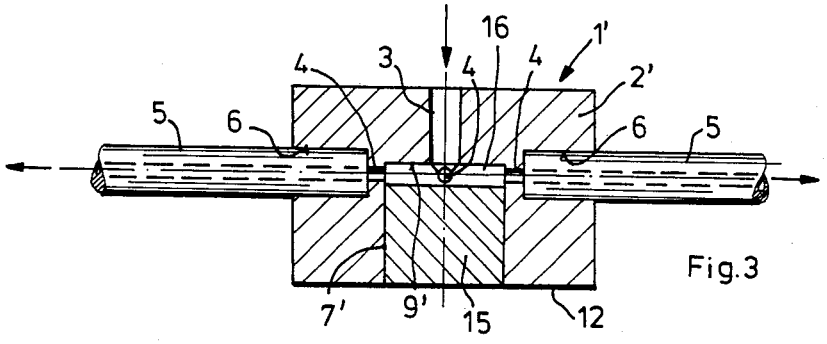
FIG. 3 is a partial section through a second embodiment of the distribution device.

In the figures, equal or comparable components are indicated by the same reference, possibly with a prime mark. In FIG. 1, a mixture distribution device as a whole is indicated by 1. It is provided with a housing 2 constituted, e.g., of a light metal alloy.

In the housing 2, several flow-out line bores 4 corresponding in number to the number of cylinders of the internal combustion engine connected thereto, branch off, essentially perpendicularly, relative to a central flow-in line bore 3. The flow-out line bores 4, four of which, e.g., in the embodiment represented in the drawing, are distributed approximately uniformly over the circumference, lead to hose lines 5 which are held in bores 6 of the housing 2. Said hose lines 5 each deliver a fuel-air mixture, formed from fuel and air in a mixture forming arrangement, not shown here, and conveyed by way of of the center flow-in line bore 3, to one of the injection points associatd with the individual cylinders of the combustion engine, said injection points being provided on the intake pipes in the vicinity of the intake valves (not shown).

In the zone of the branching-off of the flow-out line bores 4 from the central flow-in line bore 3, a distribution space 11 in the shape of a relatively narrow gap is defined by the bottom 9 of a retaining bore 7 provided in he housing 2 at the side facing away from the flow-in line bore 3, and the end face 10 of an obturating body 8 pressed into the retaining bore 7. The diameter of the retaining bore 7 is substantially larger than that of the flow-in line bore 3 so that the burrs or ridges present in the region of the intersecting edges of the individual bores 3, 4 can be check and possibly removed through the retaining bore 7. The retaining bore 7 is rendered coaxial with the flow-in line bore 3 and in the embodiment represented in FIG. 1, it has a semispherical bottom 9 which with the end face 10, facing the flow-in line bore 3, of the obturating body 8, rendered here in the form of a full sphere, forms the distribution space 11 which in cross section tapers in sickle-like fashion. In place of the sphere, there may also be provided here a cylindrical obturating body with a semispherical end face. The obturating body 8 should be composed of an appropriately corrosion-resistant material, e.g., a precious metal or also glass, and relative to the retaining bore 7, it should be over-dimensioned in such a manner that it can be immobilized in the housing 2 by means of a press fit. The overall dimensions and the penetration depth of the obturating body 8, in this case the sphere 8, ought to be chosen in such a manner that the distribution space 11 has a maximum gap height of no less than 0.1 mm and no more than 0.3 mm. For example, for four-cylinder engines, a gap height of 0.15 mm has been found to be of advantage whereas engines with more cylinders require somewhat larger gap widths in order to ensure a uniform distribution of the two-phase flow over the flow-out line bores 4.

Furthermore, in the interest of a simple assembly, the dimensions should be determined in a manner such that the end face of the obturating body 8 facing away from the flow-in line bore 3 essentially ends at the end face 12 of the housing 2. In such a case, during assembly the obturating body needs to be pressed into the housing only until its rear end face is flush with the housing end face 12.

Figure 4:
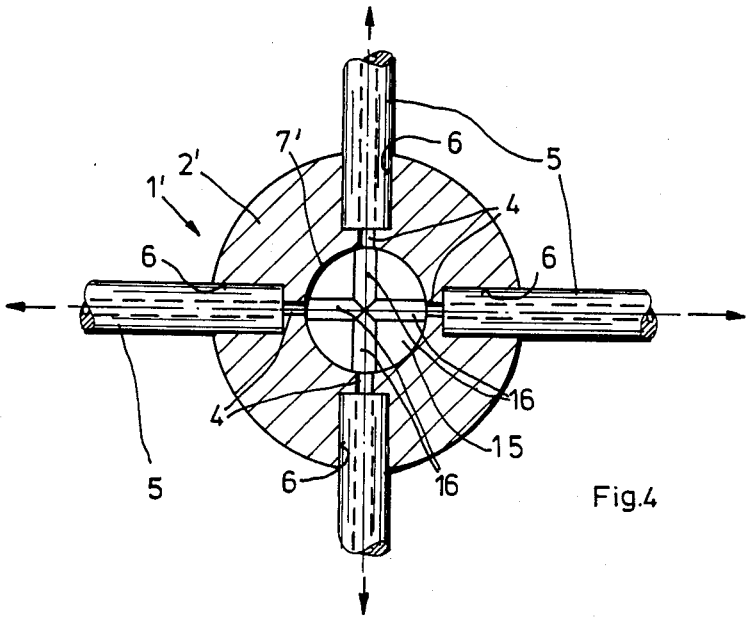
FIG. 4 is a cross section of the distribution device shown in FIG. 3, again passing through the plane of the flow-out line bores.

The embodiment represented in FIGS. 3 and 4 differs from that in FIGS. 1 and 2 in that the obturating body 15 is in the shape of a cylindrical stopper which on its end, facing the flow-in line bore 3, has worked-in distribution channels 16 which extend from the center towards the individual flow-out line bores 4. It is also possible to provide the distribution channels 16 in part on the bottom 9', which in this case is flat, of the purely cylindrical retaining bore 7', i.e., in the housing 2'. In this embodiment, the distribution space is formed by the distribution channels 16 so that it becomes possible to press the obturating body 15 into the retaining bore 7' until its end face comes in contact with the bottom 9' of the retaining bore 7'.

The essential advantages of the distribution device according to the invention reside in that through the relatively spacious retaining bore, it becomes possible to check and, if necessary remove, the burrs or ridges produced during manufacture at the intersecting edges of the flow-in and flow-out openings provided to guide the flow. Moreover, distribution space which is essential for distribution of the two-phase flow can be produced with utmost precision and simple molding tools and can be adjusted by simple means, so that the distribution device, even if manufactured on a large scale, provides a favorable uniform distribution.

While the invention has been illustrated and described as embodied in a distribution device for a two-phase flow, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

We claim:

1. A device for uniform distribution of a two-phase flow containing a liquid and a gaseous component, in particular a fuel-air mixture in a mixture delivery arrangement of an automobile, with a flow-in line bore arranged centrally in a housing and with a plurality of flow-out line bores arranged within a plane extending essentialy perpendicularly to the flow-in line and connected with the flow-in line bore, whereby the flow-in line bore is bounded by the end face of an obturating body pressed into a retaining bore arranged in the housing coaxially with the flow-in line bore but beyond the plane of the flow-out line bores, characterized in that the retaining bore is provided, in the region of the connection between the flow-in line bore and the flow-out line bore, with a substantially larger diameter than the flow-in line bore, and in that between the end face of the obturating body and the bottom of the retaining bore is formed a distribution space in the form of a narrow gap into which open the flow-out line bores.

2. A distribution device as defined in claim 1, wherein the distribution space has a height of approximately 0.1–0.3 mm.

3. A distribution device as in defined claim 1, wherein the housing has an end surface, the obturating body having a rear side and being provided so as to be pressable into the retaining bore to a point where the rear side is level with the end surface of the housing.

4. A distribution device as in either one of claims 1 to 3, wherein the obturating body has a cylindrical shape.

5. A distribution device for a two-phase flow containing a liquid and a gaseous component, the device comprising: a housing having a centrally arranged flow-in line bore and a plurality of flow-out line bores arranged within a plane substantially perpendicular to said flow-in line and connected with said flow-in line bore, said housing defining a retaining bore provided coaxial to said flow-in line bore and having a bottom extending beyond said plane of said flow-out line bores and a diameter in the region of the connection between said flow-in and said flow-out line bores which is substantially larger than that of said flow-in line bore; and an obturating body having an end face and being pressable into said retaining bore so that said end face bounds said flow in line bore so as to define a narrow gap distribution space between said obturating body end face and said retaining bore bottom into which said flow-out line bores open.

6. A device for uniform distribution of a two-phase flow containing a liquid and a gaseous component, in particular a fuel-air mixture in a mixture delivery arrangement of an automobile, with a flow-in line bore arranged centrally in a housing and with a plurality of flow-out line bores arranged within a plane extending essentially perpendicularly to the flow-in line and connected with the flow-in line bore, whereby the flow-in line bore is bounded by the end face of an obturating body pressed into a retaining bore arranged in the housing coaxially with the flow-in line bore but beyond the plane of the flow-out line bores, characterized in that the retaining bore is provided with a substantially larger diameter than the flow-in line bore, and in that between the end face of the obturating body and the bottom of the retaining bore is formed a distribution space in the form of a narrow gap into which open the flow-out line bores, the bottom of the retaining bore being formed with a semi-spherical contour, and the obturating body having a spherical shape which forms, together with the retaining bore bottom a sickle-shaped distribution space.

7. A distribution device as defined in claim 6, wherein the distribution space has a height of approximately 0.1–0.3 mm.

8. A distribution device as defined in claim 6, wherein the housing has an end surface, the obturating body having a rear side and being provided so as to be pressable into the retaining bore to a point where the rear side is level with the end surface of the housing.

9. A device for uniform distribution of a two-phase flow containing a liquid and a gaseous component, in particular a fuel-air mixture in a mixture delivery arrangement of an automobile, with a flow-in line bore arranged centrally in a housing and with a plurality of flow-out line bores arranged within a plane extending essentially perpendicularly to the flow-in line and connected with the flow-in line bore, whereby the flow-in line bore is bounded by the end face of an obturating body pressed into a retaining bore arranged in the housing coaxially with the flow-in line bore but beyond the plane of the flow-out line bores, characterized in that the retaining bore is provided with a substantially larger diameter than the flow-in line bore, and in that between the end face of the obturating body and the bottom of the retaining bore is formed a distribution space in the form of a narrow gap into which open the flow-out line bores, said obturating body having a cylindrical shape with and end face on which distribution channels are arranged so as to lead from the flow-in line bore to the flow-out line bores.

10. A distribution device as defined in claim 9, wherein the distribution space has a height of approximately 0.1–0.3 mm.

11. A distribution device as defined in claim 9, wherein the housing has an end surface, the obturating body having a rear side and being provided so as to be pressable into the retaining bore to a point where the rear side is level with the end surface of the housing.

12. A device for uniform distribution of a two-phase flow containing a liquid and a gaseous component, in particular a fuel-air mixture in a mixture delivery arrangement of an automobile, with a flow-in line bore arranged centrally in a housing and with a plurality of flow-out line bores arranged within a plane extending essentially perpendicularly to the flow-in line and connected with the flow-in line bore, whereby the flow-in line bore is bound by the end face of an obturating body pressed into a retaining bore arranged in the housing coaxially with the flow-in line bore but beyond the plane of the flow-out line bores, characterized that the retaining bore is provided with a substantially larger diameter than the flow-in line bore, and in that between the end face of the obturating body and the bottom of the retaining bore is formed a distribution space in the form of a narrow gap into which open the flow-out line bores, the obturating body being provided with a cylindrical shape, and the bottom of the retaining bore being provided with a plurality of distribution channels arranged so as to lead from the flow out line bores.

13. A distribution device as defined in claim 12, wherein the distribution space has a height of approximately 0.1–0.3 mm.

14. A distribution device as defined in claim 12, wherein the housing has an end surface, the obturating body having a rear side and being provided so as to be pressable into the retaining bore to a point where the rear side is level with the end surface of the housing.

* * * * *